US010480244B2

(12) United States Patent
Chen

(10) Patent No.: US 10,480,244 B2
(45) Date of Patent: Nov. 19, 2019

(54) ADJUSTABLE CORD WINDER FOR USE WITH CURTAIN

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 149 days.

(21) Appl. No.: 15/802,068

(22) Filed: Nov. 2, 2017

(65) Prior Publication Data

US 2018/0119490 A1 May 3, 2018

(30) Foreign Application Priority Data

Nov. 2, 2016 (TW) ..... 105135485 A

(51) Int. Cl.

| | |
|---|---|
| ***E06B 9/322*** | (2006.01) |
| ***E06B 9/78*** | (2006.01) |
| ***E06B 9/42*** | (2006.01) |
| *E06B 9/40* | (2006.01) |

(52) U.S. Cl.

CPC ..... *E06B 9/78* (2013.01); *E06B 9/42* (2013.01); *E06B 2009/402* (2013.01)

(58) Field of Classification Search

CPC ..... E06B 2009/3225; E06B 9/78; E06B 9/42; E06B 9/30; E06B 9/32; B65H 75/486

See application file for complete search history.

(56) References Cited

U.S. PATENT DOCUMENTS

| | | | | |
|---|---|---|---|---|
| 9,797,189 | B2 * | 10/2017 | Huang | E06B 9/322 |
| 10,273,748 | B2 * | 4/2019 | Chen | B65H 57/14 |
| 2016/0340975 | A1 * | 11/2016 | Huang | E06B 9/322 |
| 2017/0321477 | A1 * | 11/2017 | Chen | E06B 9/322 |
| 2018/0202220 | A1 * | 7/2018 | Huang | E06B 9/322 |

FOREIGN PATENT DOCUMENTS

| | | |
|---|---|---|
| TW | M263877 U | 5/2005 |
| TW | M322458 U | 11/2007 |

* cited by examiner

*Primary Examiner* — Catherine A Kelly
*Assistant Examiner* — Jeremy C Ramsey
(74) *Attorney, Agent, or Firm* — Muncy, Geissler, Olds & Lowe, P.C.

(57) ABSTRACT

An adjustable cord winder includes a winding unit, two cord-winding gears, two glide units, and two driving cords. The winding unit has two coil spring gears. A coil spring is connected between the coil spring gears. Each cord-winding gear meshes with one of the coil spring gears and thus rotates synchronously with the coil spring gear. Each glide unit has a roller unit capable of rotating by a specific angle and rollers freely, rotatably disposed at the roller unit. Each driving cord has one end connected to the cord-winding gear to allow the driving cord to wind on or let out from the cord-winding gear. The driving cords wind on at least one roller. The adjustable cord winder is characterized by the rollers for enhancing stability and smoothness of the driving process of the driving cords, and the roller unit for adjusting the tension on the driving cords.

8 Claims, 7 Drawing Sheets

ADJUSTABLE CORD WINDER FOR USE WITH CURTAIN

BACKGROUND OF THE INVENTION

1. Field of the Invention

The present invention relates to curtains and, more particularly, to an adjustable cord winder for use with a curtain.

2. Description of the Prior Art

From a structural perspective, conventional curtains fall into two categories: those come with driving cords, and those dispense with driving cords. The former category uses a driving cord in altering the height of a curtain to unfold and fold the curtain. The latter category requires a user to lift or lower a lower beam by hand so that the curtain unfolds and folds.

Both Taiwan patent M263877 and Taiwan patent M322458 disclose a driving mechanism for driving a curtain to ascend and descend. By contrast, Taiwan patent M263877 and Taiwan patent M322458 fail to achieve the following advantageous features: reduction of structural complexity, satisfactory driving of the curtain, and appropriate adjustment of tension on a driving cord.

SUMMARY OF THE INVENTION

It is an objective of the present invention to provide an adjustable cord winder for use with a curtain such that the adjustable cord winder adjusts the tension on driving cords and thus renders the driving cords effective in driving the curtain.

In order to achieve the above and other objectives, the present invention provides an adjustable cord winder which comprises a base, a winding unit, two cord-winding gears, two glide units, and two driving cords. The base has two ends each provided with a polygonal positioning recess. The winding unit has two coil spring gears and a coil spring. The two coil spring gears are freely, rotatably disposed at the base and mesh together. The coil spring connects the two coil spring gears and selectively winds on one of the coil spring gears. Each cord-winding gear is rotatably disposed at the base and meshes with a corresponding one of the coil spring gears such that the cord-winding gear is driven to rotate synchronously with the coil spring gear which meshes with the cord-winding gear. The glide unit has a roller unit and rollers. The roller unit is positioned proximate to a corresponding one of the cord-winding gears, has a polygonal positioning portion, and is demountably, engageably disposed in the positioning recesses of the base through the at least one positioning portion. When mounted within the base, the roller unit is prevented from rotating relative to the base. When demounted from the base, the roller unit is capable of rotating relative to the base by a specific angle. The rollers is freely, rotatably disposed at the roller unit. The driving cords each wind on at least one roller of each glide unit. Each driving cord has an end connected to a corresponding one of the cord-winding gears to allow the driving cord to wind on or let out from the cord-winding gear because of rotation thereof, wherein the other end of the driving cord is disposed outside the base to connect with a lower beam.

Therefore, in the course of unfolding a curtain connected to the lower beam, the free rotation of the rollers enables the driving cords to steadily and smoothly, optimizing the driving process. Furthermore, when demounted, the roller unit can be rotated by a specific angle to enable the rollers to move the driving cords synchronously with the roller unit, so as to adjust the tension on the driving cords further.

The fine structures, features, assembly and operation of the adjustable cord winder of the present invention are hereunder illustrated with a preferred embodiment and described in detail. However, persons skilled in the art understand that the detailed description and the preferred embodiment are illustrative of the present invention rather than restrictive of the claims of the present invention.

DETAILED DESCRIPTION OF THE EMBODIMENT OF THE INVENTION

Figure 1:
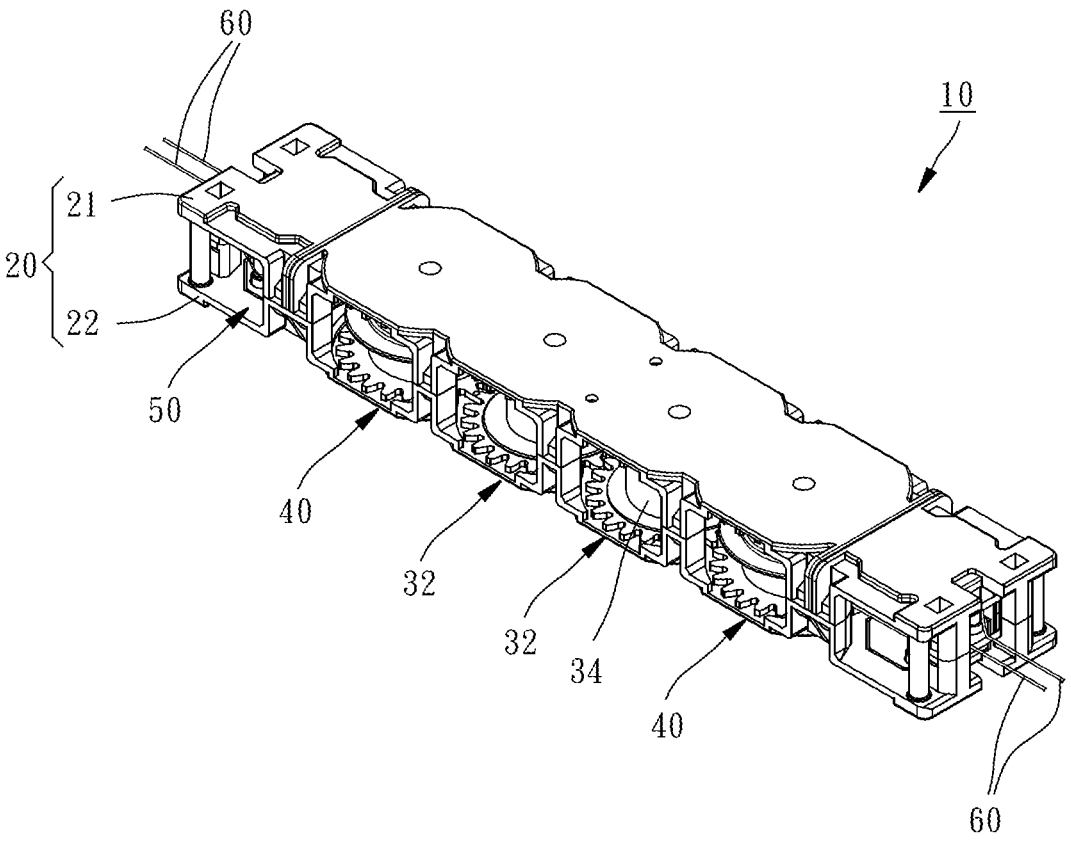
FIG. 1 is a perspective view of an adjustable cord winder of the present invention.
Figure 2:
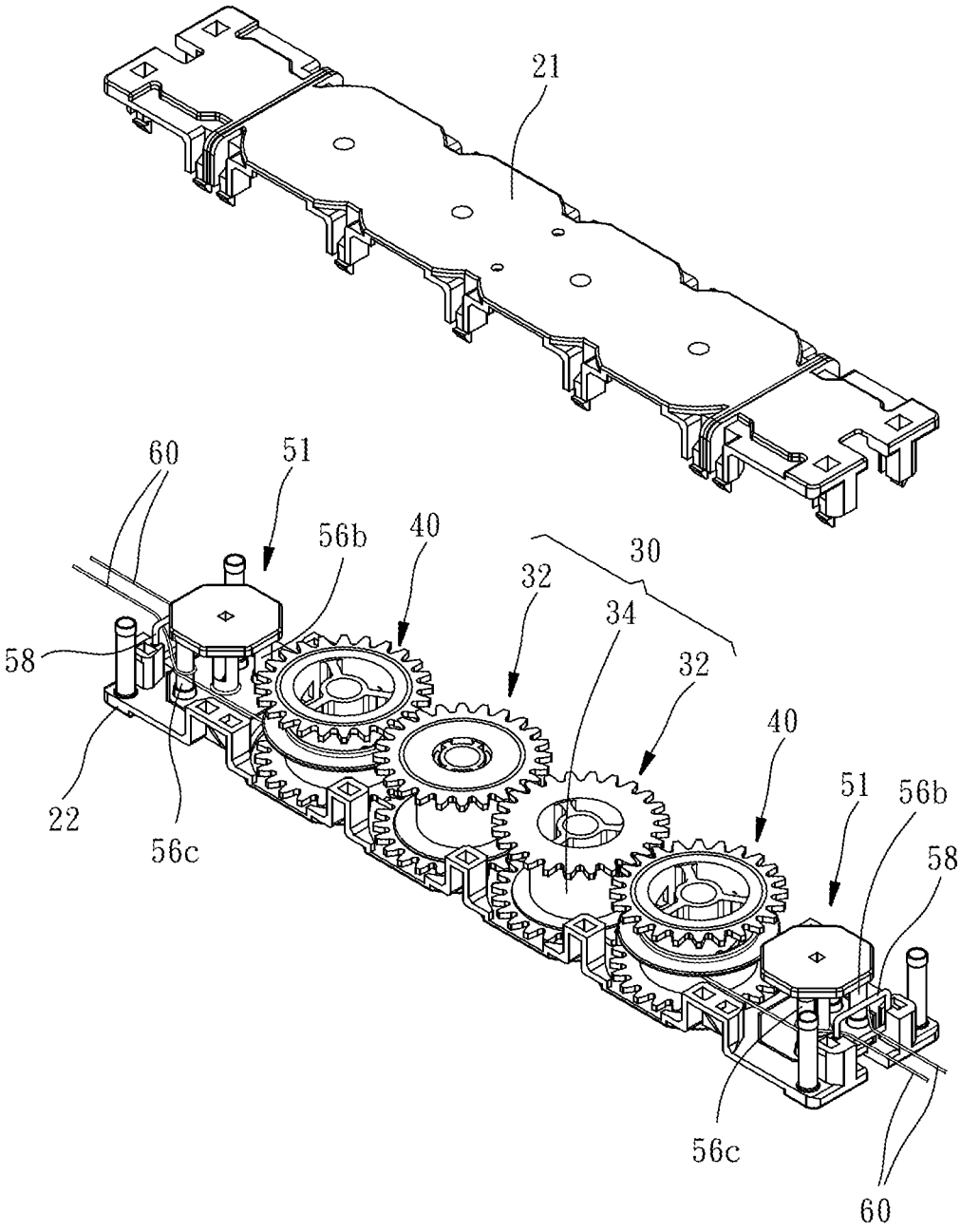
FIG. 2 is a partial exploded view of the adjustable cord winder of the present invention.

Referring to FIG. 1 and FIG. 2, an adjustable cord winder 10 of the present invention comprises a base 20, a winding unit 30, two cord-winding gears 40, two glide units 50, and four driving cords 60.

Figure 3:
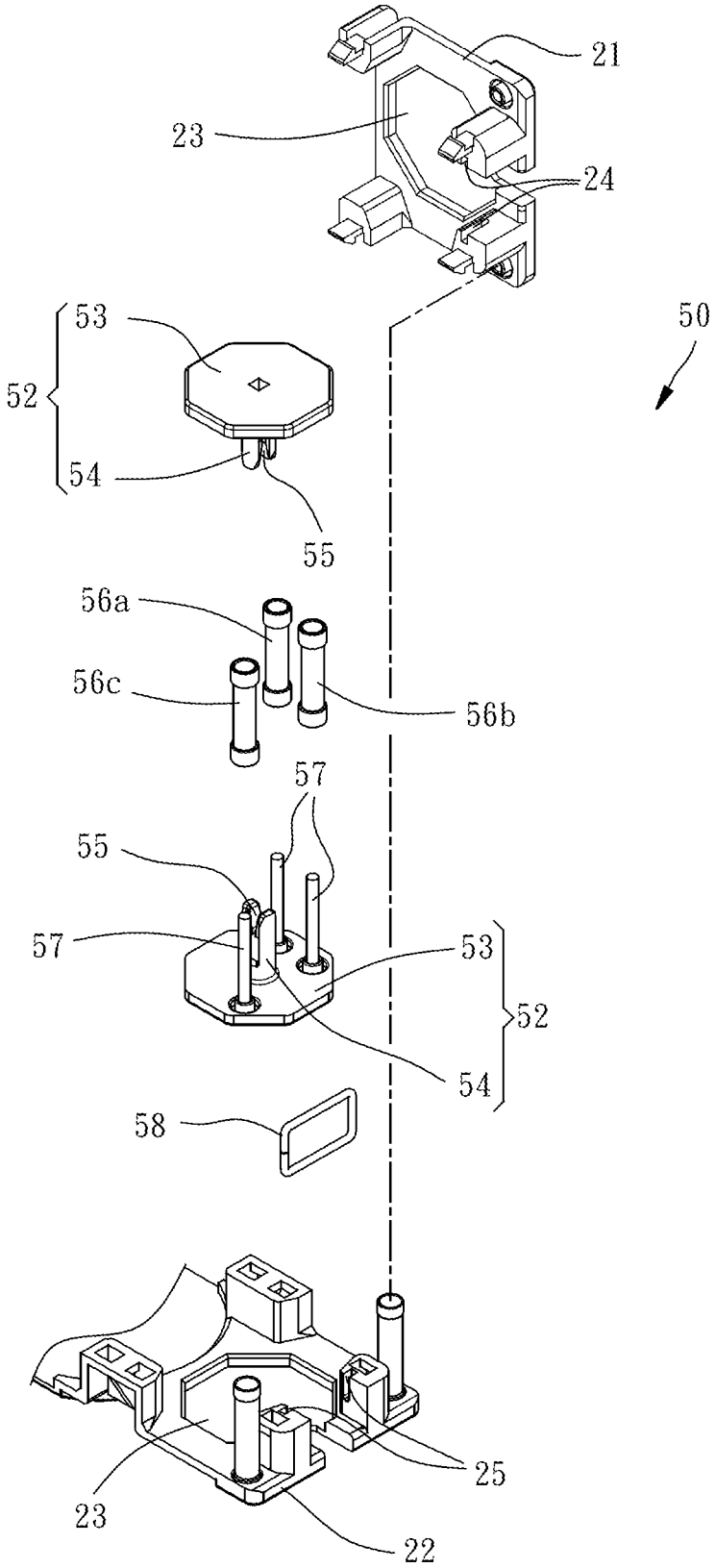
FIG. 3 is an exploded view of a glide unit of the present invention.

Referring to FIG. 1, FIG. 2 and FIG. 3, the base 20, which is disposed in an upper beam 12, has a top plate 21 and a bottom plate 22 corresponding in position to the top plate 21. Two positioning recesses 23 are disposed on the two ends of the bottom surface of the top plate 21, respectively. Another two positioning recesses 23 are disposed on the two ends of the top surface of the bottom plate 22, respectively. The positioning recesses 23 are polygonal. In this embodiment, the positioning recesses 23 are octagonal. Two opposing upper slots 24 are disposed at two ends of the top plate 21, respectively. Two opposing lower slots 25 are disposed at two ends of the bottom plate 22, respectively. The upper and lower slots 24, 25 correspond in position to each other and are in communication with each other.

The winding unit 30 has two coil spring gears 32 and a coil spring 34. The two coil spring gears 32 are pivotally disposed at the base 20 and mesh together. The two ends of the coil spring 34 are connected to the two coil spring gears 32, respectively, such that the coil spring 34 winds on one of the coil spring gears 32 because of the relative rotation of the two coil spring gears 32.

Each cord-winding gear 40 is pivotally disposed at the base 20 and meshes with one of the coil spring gears 32. Hence, the cord-winding gear 40 is driven by, and thus rotates in synchrony with, the coil spring gear 32 which meshes with the cord-winding gear 40.

The two glide units 50 are positioned proximate to the cord-winding gears 40, respectively. Each glide unit 50 has a roller unit 51. Referring to FIG. 3, the roller unit 51 has two opposing half units 52. The half units 52 each have a positioning portion 53 and an abutting axle 54. The positioning portions 53 are polygonal. In this embodiment, the positioning portions 53 are octagonal. One end of the abutting axle 54 is connected to the positioning portion 53. The other end of the abutting axle 54 has a hook portion 55 such that the two half units 52 are fixed to each other by the hook portions 55 of the abutting axles 54. Hence, the roller unit 51 is prevented from rotating relative to the base 20 as soon as the roller unit 51 is mounted on the positioning recesses 23 of the base 20 through the positioning portions 53. By contrast, the roller unit 51 can rotate freely relative to the base 20 as soon as the positioning portions 53 of the roller unit 51 separate from the positioning recesses 23 of the base 20. Since the positioning portions 53 of the roller unit 51 correspond in shape to the positioning recesses 23 of the base 20, the positioning portions 53 of the roller unit 51 can still be engaged with the positioning recesses 23 of the base 20, regardless of the angle by which the roller unit 51 rotates.

The two glide units 50 each have three rollers 56*a*~56*c*. The three rollers 56*a*~56*c* are each rotatably disposed between the two positioning portions 53 of the roller unit 51 by a roller spindle 57. The two rollers 56*a*~56*b* are arranged side by side and disposed on one side of the two abutting axles 54 of the roller unit 51. The roller 56*c* is disposed on the opposite side of the two abutting axles 54 of the roller unit 51. Referring to FIG. 2 and FIG. 3, two glide units 50 each have a cord-guiding ring 58. The cord-guiding ring 58 is engageably disposed in the upper and lower slots 24, 25 of the base 20.

Figure 4:
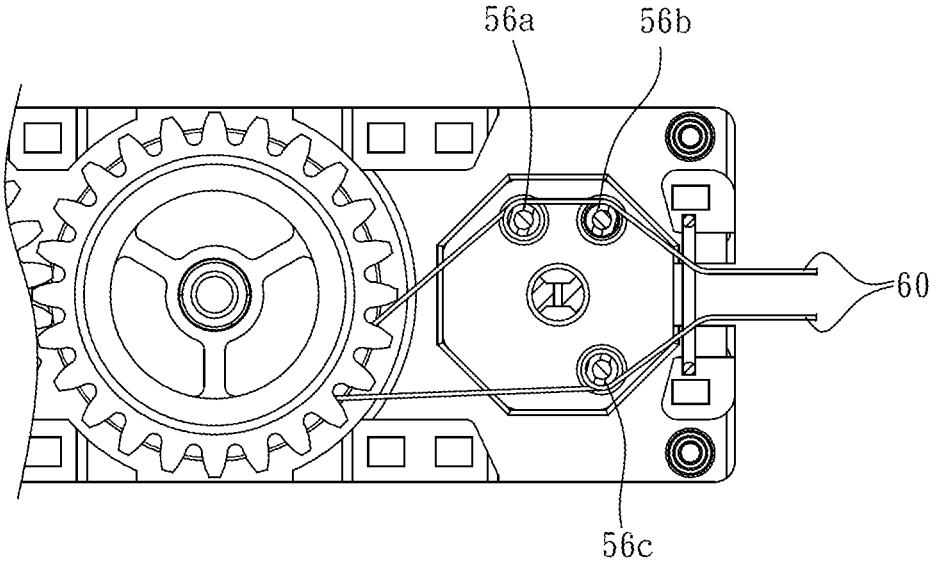
FIG. 4 is a partial cross-sectional view of the glide unit of the present invention.
Figure 5:
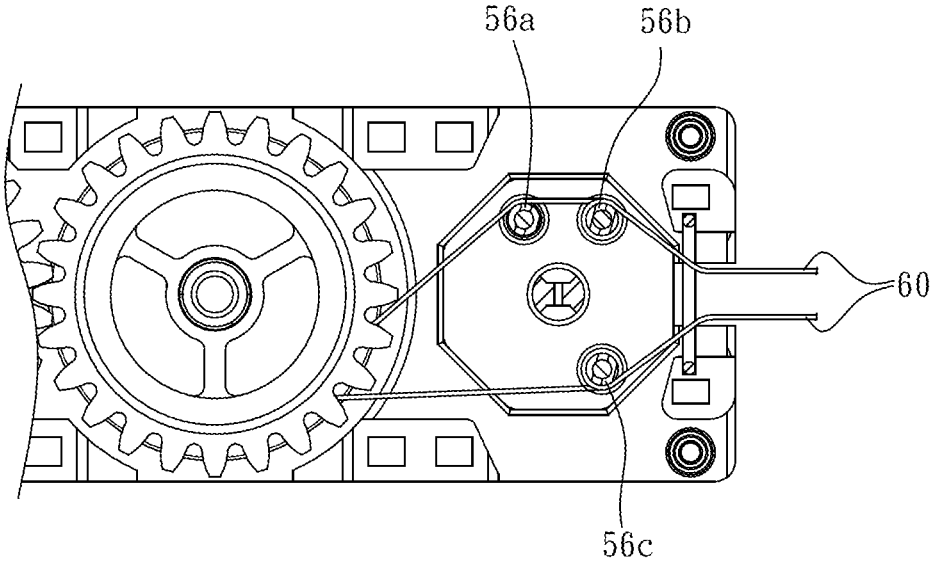
FIG. 5 is similar to FIG. 4 and shows different aspects of driving cords.

The four driving cords 60 are arranged in pairs. Every two paired driving cords 60 each have one end fixed to a corresponding one of the cord-winding gears 40; hence, the two paired driving cords 60 wind on or let out from the cord-winding gear 40 because of rotation thereof. The two paired driving cords 60 passing through the glide units 50 can wind on the rollers 56*a*~56*c* in different ways (see FIG. 4 and FIG. 5). For example, after completing one revolution around the roller 56*a*, one of the two paired driving cords 60 touches the roller 56*b* and then leaves the roller 56*b* to exit the base 20. Alternatively, after touching the roller 56*a* and leaving the roller 56*a* to reach the roller 56*b*, one of the two paired driving cords 60 completes one revolution around the roller 56*b* and then exits the base 20. In a variant embodiment, one of the two paired driving cords 60 completes one revolution around each of the two rollers 56*a*~56*b* and then exits the base 20. Similarly, the other one of the two paired driving cords 60 either completes one revolution around the roller 56*c* and then exits the base 20 or touches and leaves the roller 56*c* to exit the base 20. Regardless of the way of winding, the two paired driving cords 60 abut against the cord-guiding ring 58 at the point in time when the two paired driving cords 60 exit the base 20, so as to enhance motion stability. After exiting the base 20, the driving cords 60 connect with a lower beam 14 whereby the driving cords 60 are driven to move.

Figure 6:
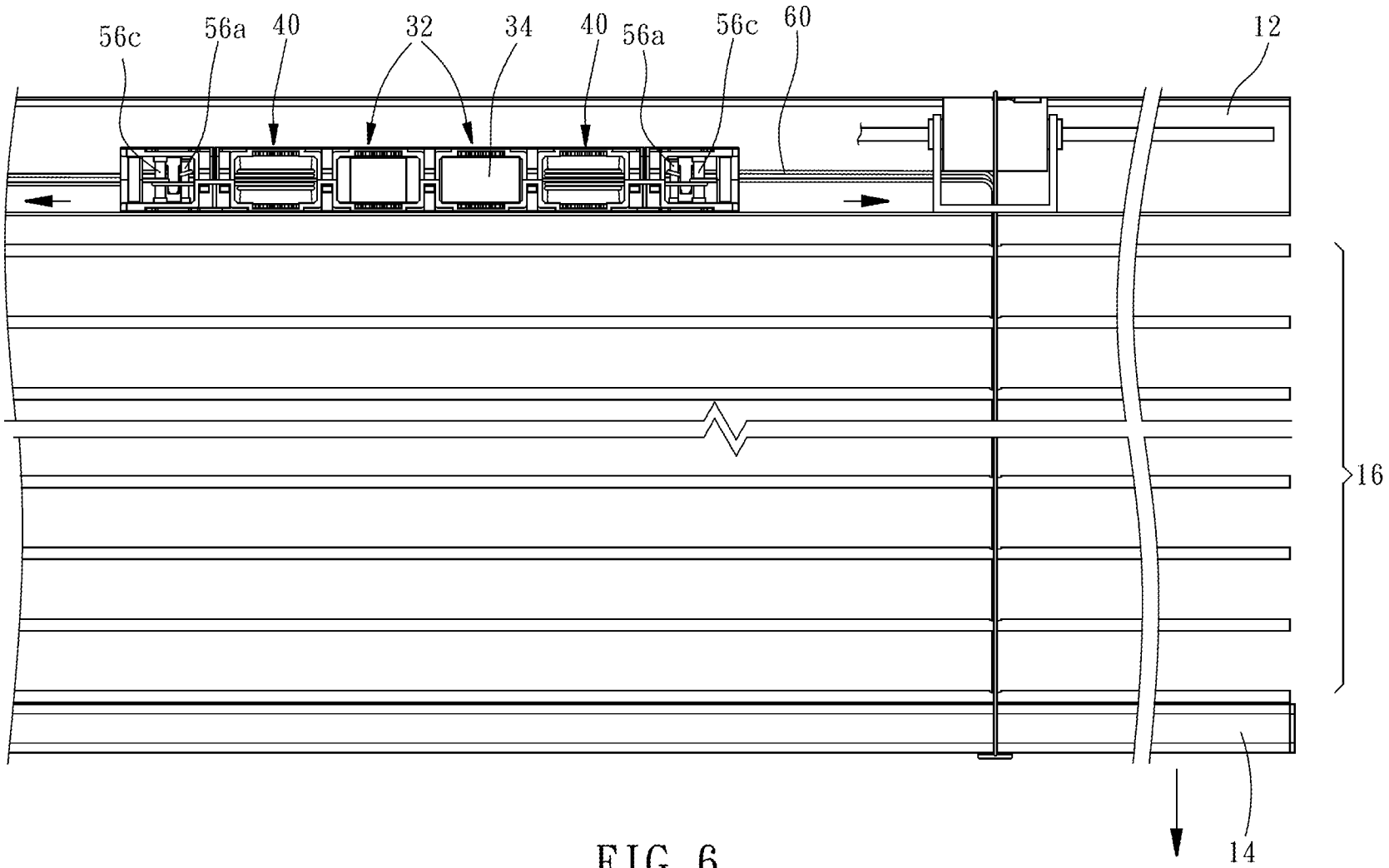
FIG. 6 is a front view of the adjustable cord winder operating in conjunction with a curtain according to the present invention, showing the curtain unfolded.

Referring to FIG. 6, to unfold a curtain 16 disposed between the upper and lower beams 12, 14, a user pulls the lower beam 14 downward such that the paired driving cords 60 drive the cord-winding gear 40 connected thereto to rotate, and then the rotating cord-winding gear 40 drives the coil spring gear 32 (which meshes with the cord-winding gear 40) to rotate. The coil spring 34 generates a resilient restoring force because of relative rotation of the two coil spring gears 32. It is only when the user unfolds the curtain 16 fully and then stops pulling the lower beam 14 that the weight of the lower beam 14 is statically balanced against the resilient restoring force of the coil spring 34, thereby keeping the curtain 16 unfolded.

Figure 7:
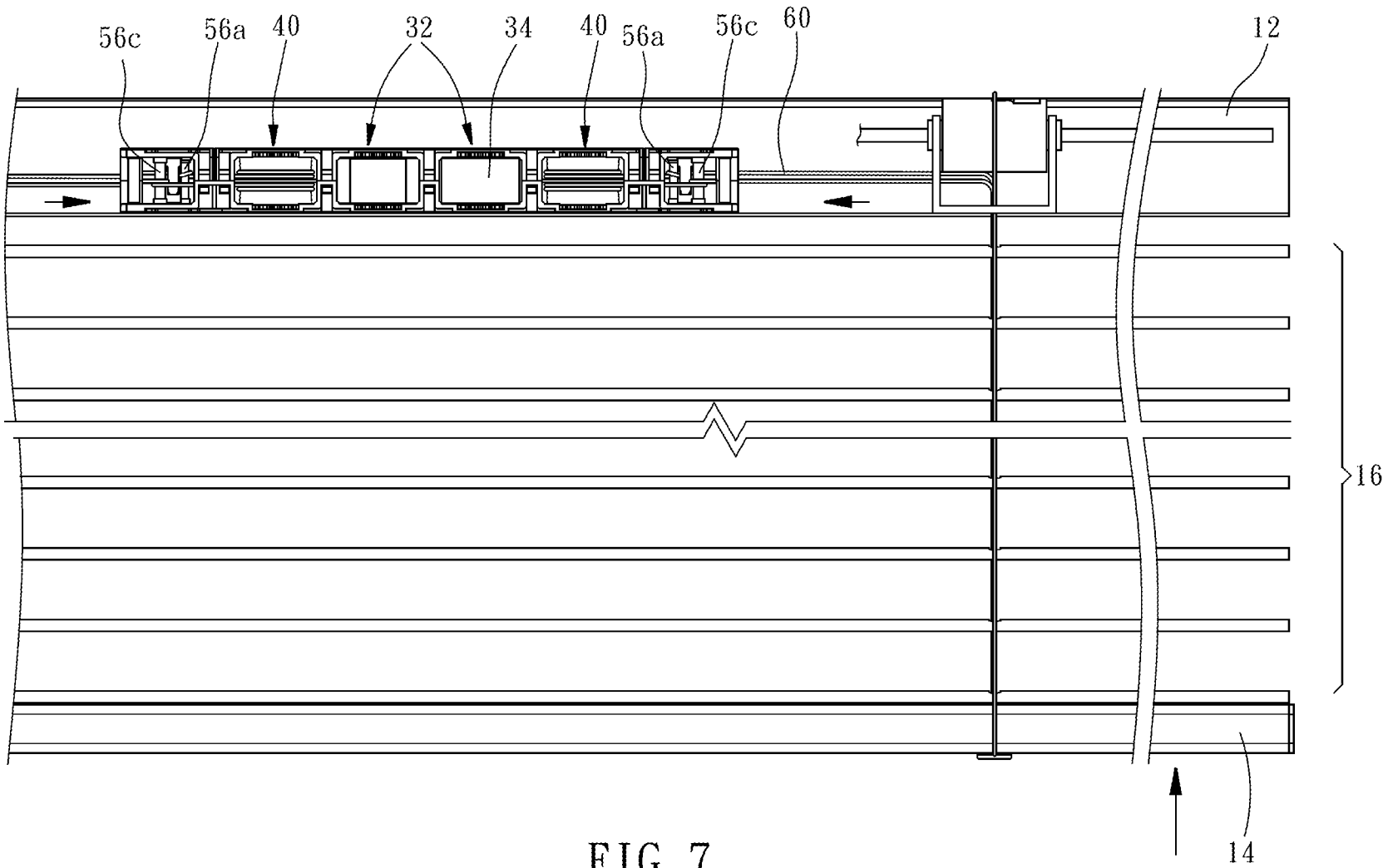
FIG. 7 is similar to FIG. 6 and shows the curtain folded.

Referring to FIG. 7, to fold the curtain 16, the user thrusts and lifts the lower beam 14 such that the upward thrust exerted on the curtain 16 and the resilient restoring force generated by the coil spring 34 together drive the two coil spring gears 32 to rotate simultaneously in opposite directions. When rotating in opposite directions, the two coil spring gears 32 drive the cord-winding gear 40 to rotate, as the two coil spring gears 32 mesh with the cord-winding gear 40. The rotating cord-winding gear 40 winds the driving cords 60 until the curtain 16 is fully folded, and thereafter the user stops exerting the upward thrust on the lower beam 14. At this point in time, the weight of the lower beam 14 is statically balanced against the resilient restoring force of the coil spring 34 again, thereby keeping the curtain 16 folded.

In the course of unfolding or folding the curtain 16, the rollers 56*a*~56*c*, which the driving cords 60 wind on, rotate together with the driving cords 60 because of the friction between each roller 56*a*~56*c* and a corresponding one of the driving cords 60. Therefore, the driving cords 60 move steadily and smoothly, optimizing the driving process.

Figure 8:
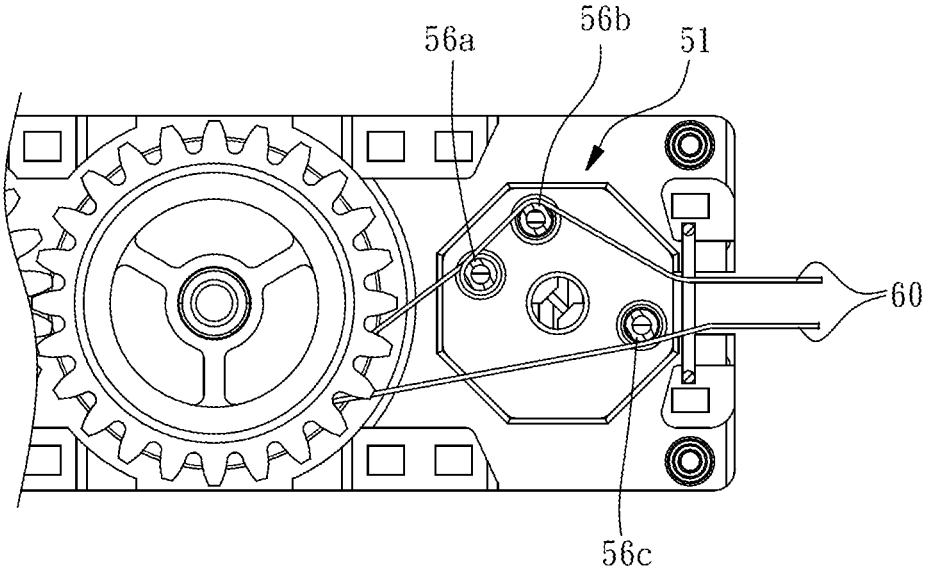
FIG. 8 is similar to FIG. 4 and shows a roller unit rotated counterclockwise by 45 degrees.
Figure 9:
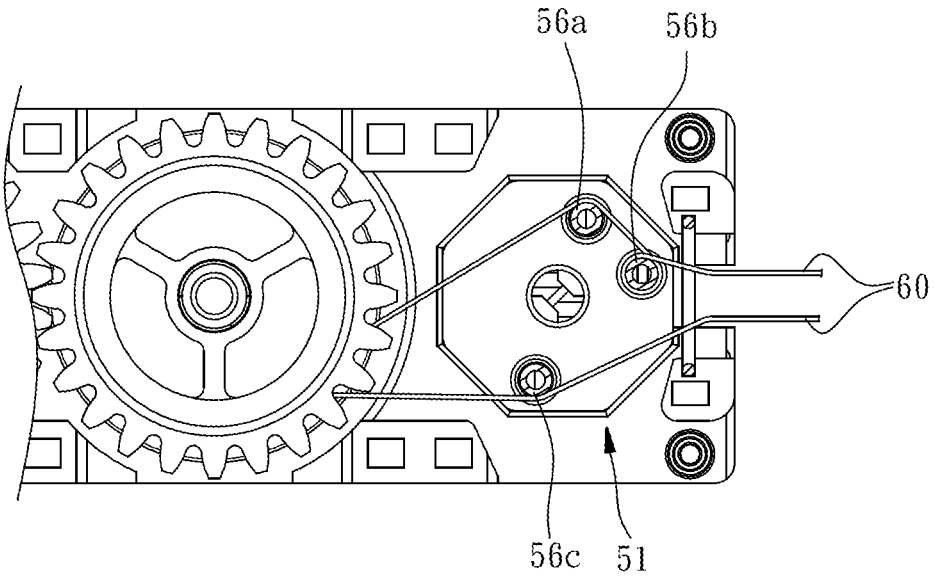
FIG. 9 is similar to FIG. 8 and shows the roller unit rotated clockwise by 45 degrees.

If the driving cords 60 slack, the driving process will be compromised. To fix the compromised driving process, the user will need to adjust the tension on the driving cords 60 appropriately. To this end, the user removes the top plate 21 of the base 20, removes the positioning portion 53 of the roller unit 51 from the positioning recess 23 of the bottom plate 22 of the base 20 to separate the roller unit 51 therefrom, and rotate the roller unit 51 by an angle according to the magnitude of the intended tension. Since the positioning portions 53 of the roller unit 51 and the positioning recesses 23 of the base 20 are polygonal, the rollers 56*a*~56*c* rotate together with the roller unit 51 in the course of the rotation of the roller unit 51 as shown in FIG. 8 and FIG. 9; meanwhile, the driving cords 60 are pulled by the rollers 56*a*~56*c* which wind thereon such that the tension on the driving cords 60 is further adjusted. Upon completion of the tension, the user mounts the roller unit 51 and the top plate 21 of the base 20 sequentially on the bottom plate 22 of the base 20.

In conclusion, the adjustable cord winder 10 of the present invention is not only characterized by the three rollers 56*a*~56*c* capable of free rotation to enhance the stability and smoothness of the driving process of the driving cords 60, but is also characterized by the roller unit 51 which, when demounted, can be rotated by a specific angle to adjust the tension on the driving cords 60.

What is claimed is:

1. An adjustable cord winder for use with a curtain, comprising:

a base having two ends each provided with at least one respective polygonal positioning recess;

a winding unit having two coil spring gears and a coil spring, with the two coil spring gears rotatably disposed at a base and meshing together, wherein the coil spring connects the two coil spring gears and selectively winds on one of the coil spring gears;

two cord-winding gears rotatably disposed at the base and meshing with the coil spring gears of the winding unit, respectively;

two glide units each having a respective roller unit and a plurality of rollers rotatably disposed at the roller unit, with each roller unit positioned proximate to a corresponding one of the cord-winding gears, having at least one respective polygonal positioning portion, and demountably and engageably disposed in a respective one of the polygonal positioning recesses of the base through the at least one polygonal positioning portion; and at least two driving cords each winding on at least one of said rollers of a corresponding one of the glide units, each said driving cord having an end connected to a corresponding one of the cord-winding gears to allow the driving cord to wind on or let out from the cord-winding gear because of rotation thereof, wherein another end of the driving cord is disposed outside the base.

2. The adjustable cord winder for use with a curtain according to claim 1, wherein the base has a top plate and a bottom plate corresponding in position to the top plate, with two said polygonal positioning recesses disposed on two ends of a bottom surface of the top plate, respectively, and another two said polygonal positioning recesses disposed on two ends of a top surface of the bottom plate, respectively, and with two said polygonal positioning portions disposed at two opposing ends of the roller unit of each said glide unit, respectively.

3. The adjustable cord winder for use with a curtain according to claim 2, wherein the roller unit of each said glide unit has two opposing half units, with the two half units each having an abutting axle, the two abutting axles each having an end connected to one said polygonal positioning portion, allowing other ends of the two abutting axles to abut against each other, and allowing each said roller to be disposed between the polygonal positioning portions of the two half units by a respective roller spindle.

4. The adjustable cord winder for use with a curtain according to claim 3, wherein the abutting axles of the two half units each have a hook portion, and the hook portions of the two abutting axles are hooked together.

5. The adjustable cord winder for use with a curtain according to claim 3, wherein the glide units each have three said rollers, with two arranged side by side and disposed on a side of the abutting axles of the two half units, and the other one disposed on an opposite side of the abutting axles of the two half units.

6. The adjustable cord winder for use with a curtain according to claim 1, wherein the glide units each have a cord-guiding ring disposed at an end of the base and abutting against a corresponding one of the driving cords.

7. The adjustable cord winder for use with a curtain according to claim 1, wherein the polygonal positioning recesses of the base and the polygonal positioning portions of the roller units are octagonal.

8. The adjustable cord winder for use with a curtain according to claim 1, wherein there are four driving cords, with four said driving cords arranged in pairs, every two paired said driving cords each being fixed to a corresponding one of the cord-winding gears, allowing the four driving cords each to wind on at least one said roller of the glide unit.

* * * * *